US007435194B1

(12) United States Patent
Lewis

(10) Patent No.: US 7,435,194 B1
(45) Date of Patent: Oct. 14, 2008

(54) METHOD FOR PRACTICING PITCHING AND APPARATUS THEREFOR

(76) Inventor: Joseph Edwin Lewis, 14750 Lakemont Dr., Lake Elizabeth, CA (US) 93532

( * ) Notice: Subject to any disclaimer, the term of this patent is extended or adjusted under 35 U.S.C. 154(b) by 301 days.

(21) Appl. No.: 10/961,551

(22) Filed: Oct. 8, 2004

Related U.S. Application Data

(60) Provisional application No. 60/516,467, filed on Nov. 1, 2003.

(51) Int. Cl.
*A63B 69/00* (2006.01)
*A63F 7/20* (2006.01)

(52) U.S. Cl. ..... 473/454; 473/422; 273/317.9; 273/317.6

(58) Field of Classification Search ..... 473/422, 473/454–456; 273/317.6, 317.7, 317.9
See application file for complete search history.

(56) References Cited

U.S. PATENT DOCUMENTS

| | | | | | |
|---|---|---|---|---|---|
| 376,628 | A | * | 7/1888 | Bowen | 446/11 |
| 547,141 | A | * | 10/1895 | Crutchfield | 273/366 |
| 884,462 | A | * | 4/1908 | Bryant | 273/369 |
| 1,053,788 | A | * | 2/1913 | Crew | 273/317.7 |
| 1,120,468 | A | * | 12/1914 | Fleming | 273/369 |
| 1,168,829 | A | * | 1/1916 | Sheppard | 273/317.7 |
| 1,469,605 | A | * | 10/1923 | Piercy | 273/317.8 |
| 1,502,010 | A | * | 7/1924 | Banks | 446/358 |
| 1,617,789 | A | * | 2/1927 | Bamber et al. | 273/317.7 |
| 1,634,296 | A | * | 7/1927 | Mattern et al. | 273/317.7 |
| 1,731,477 | A | * | 10/1929 | Turner | 273/317.9 |
| 1,960,829 | A | * | 5/1934 | Rojahn | 273/317.7 |
| 2,040,228 | A | * | 5/1936 | Whiteley | 273/376 |
| 2,325,858 | A | * | 8/1943 | Kellermann et al. | 273/317.7 |
| 2,534,468 | A | * | 12/1950 | Mitchell | 273/317.7 |
| 3,069,166 | A | * | 12/1962 | Lindman | 273/317.9 |
| 3,111,318 | A | * | 11/1963 | Northrup | 273/317.9 |
| 3,133,733 | A | * | 5/1964 | Elseroad | 273/317.6 |
| 3,525,525 | A | * | 8/1970 | Rideout | 273/317.9 |
| 3,531,116 | A | * | 9/1970 | Trzesniewski | 463/52 |
| 4,179,123 | A | * | 12/1979 | Tsukuda | 273/108.31 |
| 4,327,913 | A | * | 5/1982 | Bock | 273/317.7 |
| 4,781,376 | A | * | 11/1988 | Barnes, Sr. | 473/455 |
| 4,936,579 | A | * | 6/1990 | Barlow | 273/108.32 |
| 5,020,801 | A | * | 6/1991 | Negron | 273/317.7 |
| 5,409,221 | A | * | 4/1995 | Cohn | 273/108.31 |
| 5,433,434 | A | * | 7/1995 | Helmetsie | 473/446 |
| 5,511,775 | A | * | 4/1996 | Parks | 473/454 |
| 5,566,935 | A | * | 10/1996 | Meharg | 473/454 |
| D376,396 | S | * | 12/1996 | Nelson | D21/780 |
| 6,350,211 | B1 | * | 2/2002 | Kolmar | 473/454 |
| 2005/0090339 | A1 | | 4/2005 | Ross et al. | |

* cited by examiner

*Primary Examiner*—Mitra Aryanpour
(74) *Attorney, Agent, or Firm*—Ted Masters

(57) ABSTRACT

A system for practicing pitching includes a batter mannequin which is selectively movable to a right handed batting position or to a left handed batting position. The batter also can be selectively moved toward and away from home plate, and has a head which automatically faces the pitcher. A catcher mannequin is disposed behind the batter mannequin, the catcher mannequin being selectively positionable along a transverse path. The catcher mannequin has a mitt which may be selectively positioned up or down. The various movements of the batter mannequin and the catcher mannequin are remotely controlled using a remote control unit.

2 Claims, 9 Drawing Sheets

Fig. 2
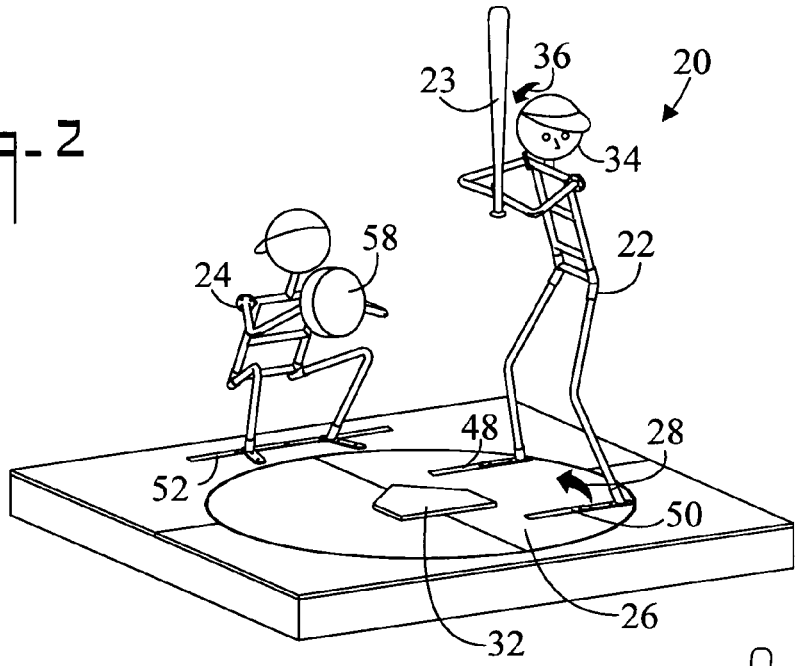
Fig. 3
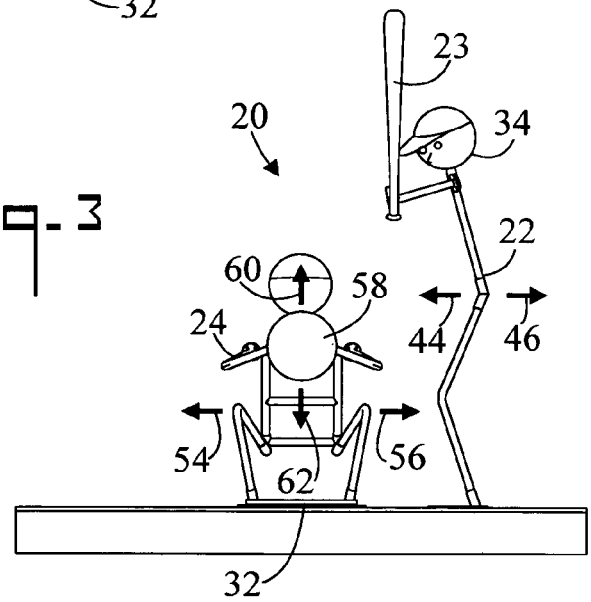
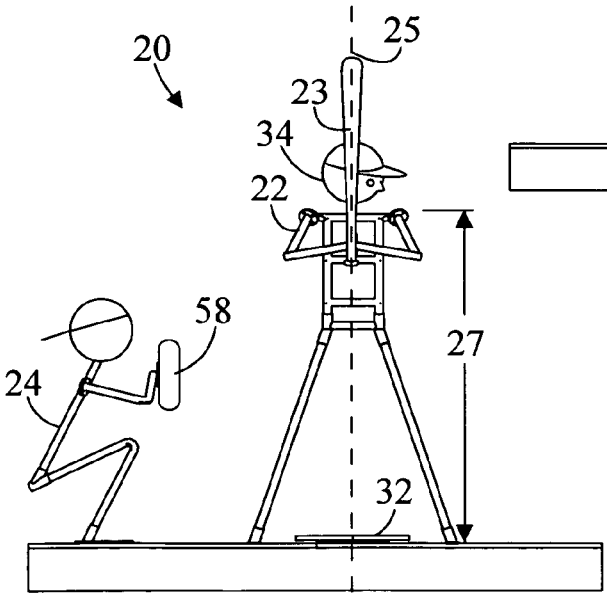
Fig. 4

METHOD FOR PRACTICING PITCHING AND APPARATUS THEREFOR

CROSS REFERENCE TO RELATED APPLICATION

This application claims the filing benefit under 35 U.S.C. § 119(e) of U.S. Provisional Application No. 60/516,467 filed Nov. 1, 2003, which is included herein by reference.

TECHNICAL FIELD

The present invention pertains generally to the games of baseball and softball, and more particularly to a method and system for practicing pitching in which the positions of a batter mannequin and a catcher mannequin are remotely controlled by a user.

BACKGROUND OF THE INVENTION

Devices for practicing pitching are known in the art. For example, U.S. Pat. No. 6,350,211 shows a baseball pitching aid wherein a simulated image of a batter facing a pitcher is provided for use in pitching practice. The lower portion of the batter includes one or more stakes which are inserted into the ground and provide a stable support. By positioning the simulated batter in an appropriate place near "home plate", a pitcher can use the batter as a reference to determine the location of the strike zone. The size of the batter can be adjusted to vary the size of the strike zone. A ball detection apparatus and audio output can be provided to indicate when a pitch is detected and whether the pitch is a ball or a strike.

U.S. Pat. No. 5,566,935 illustrates a pitching practice device having a home plate, and a batter dummy adjacent to the home plate so the pitcher can get accustomed to the presence of a batter. The batter dummy has marks to indicate the strike zone. The batter dummy can be shortened or lengthened to suit the pitcher and to give wide experience. The dummy is inflatable for light weight and ease of installation; and, the dummy has three separately inflatable compartments so only a portion of the dummy must be inflated at one time. Portions of the dummy have accordion folded sections to change the length, and a strap to fix the length of the accordion folded section. The dummy is fixed to a mat by hook and loop fasteners, so the dummy can be placed as desired for training, the mat including the simulation of home plate.

U.S. Pat. No. 5,433,434 discloses a pitching, throwing or kicking training device having a support frame, a strike zone frame which is fully adjustable in height and positionable within the support frame, and a catcher target behind the strike zone frame which is adjustable in height and position. A simulated batter is provided to aid in visualization of the strike zone, adjustable in height and reversible to simulate right- or left-handed batters. The strike zone frame may also be distorted into non-rectangular parallelograms if desired to emphasize pitching techniques. The invention is also adaptable to training lacrosse or soccer players or the like by appropriate choice of strike zone frame size and position and possibly change of player silhouette.

U.S. Pat. No. 4,781,376 depicts a training device for pitchers. The training device provides a target comprising a catcher figure and separate batter figure. Both the catcher figure and batter figure are adjustable in height to simulate different sized batters from Little League to adult size. The batter figure can be supported as a left or right handed batter and is pivotable as well as adjustable in distance from the catcher to simulate different batter box positions. A catcher's mitt target is supported on the catcher figure in different positions for different pitches and has an alarm in the pocket of the mitt to indicate an on-target pitch.

BRIEF SUMMARY OF THE INVENTION

The present invention is directed to a method and system for practicing pitching a baseball or a softball. The system includes a life-like batter mannequin which rotates to either a right handed batting position or a left handed batting position, and which can be moved toward or away from home plate. When the batter mannequin is rotated, the face of the mannequin automatically looks at the pitcher. The system also includes a life-like catcher mannequin which moves transversely behind home plate, and a catcher's mitt which may be positioned up or down. The various movements of the batter mannequin and catcher mannequin are remotely controlled from a desired location.

The system of the present invention allows someone of any ability to practice pitching a baseball/softball at a three-dimensional target which replicates the most real circumstances as possible without requiring the presence of another human being. The movement of the batter mannequin and the catcher mannequin is remotely controlled with a remote control unit, which can be located adjacent to the pitching area (pitcher's mound/rubber). As such, the pitcher is able to control the location of the batter mannequin, catcher mannequin, and the catcher mannequin's mitt to a desired position.). Alternatively, the remote control could be located at any desired location in the vicinity of the system, and for example could be operated by the pitcher's coach. The pitcher can then practice throwing in a life-like environment, for example by throwing to the location of the mannequin catcher's mitt.

In an embodiment of the invention, the mannequin batter will be in complete baseball uniform and will be positioned in the batters box in a ready position looking at the pitching area. The baseball/softball pitcher will have the ability to touch a switch and make the batter mannequin change to either a right handed batter or left handed batter and the batter mannequin's head will automatically turn to face the pitcher.

The mannequin catcher will be in complete baseball uniform including catcher's gear and positioned behind home plate in a receiving position with the catcher's mitt extended in front. The baseball/softball pitcher will have the ability to touch a switch to move the catcher left or right behind home plate in order to cover the entire plate and up to 4" outside of the plate on each side. The baseball/softball pitcher will also be able to touch a switch and the catcher's mitt will raise or lower in order to simulate a high or low target. A sensor placed behind the catcher's mitt will cause a "STRIKE" announcement to be made by a speaker or other audio device when the thrown ball strikes the catcher's mitt.

Both mannequins consist of a metal framework surrounded by a durable foam to fill out the bodies. The mannequins are then painted or alternatively dressed in full baseball uniforms to simulate the exact look and feel that a pitcher has when pitching in an actual baseball game.

The present invention can be used in an established batting cage, Major League baseball parks, Major League Bullpens, entertainment fun parks, high schools, colleges, professional baseball/softball teams and any individuals who will like to practice their pitching skills. The present invention is not gender or age specific. The mechanical mannequins can be developed as either a male or female and can be made for any age level and used in baseball or softball environments. Additionally, the mechanical mannequins can be sculpted to look exactly like any major league baseball player, so a person could be pitching to someone famous like "Sammy Sosa" batting and "Pudge Rodriguez" catching.

The mechanical mannequins can be manufactured as adult sized where someone would be pitching from 60 feet 6 inches. Alternatively, the mechanical mannequins can be manufactured as little league sized where someone would be pitching from the standard little league pitching distance. The mechanical mannequins can be manufactured as women softball players where softball players can practice their pitching skills.

Other embodiments of the invention can also include:

- A baseball dispensing machine which dispenses baseballs when someone inserts money.
- A cage like environment consisting of netting or chain link fencing to keep the balls within a restricted area.
- A ball return system that will allow the balls to be brought back to a designated area.
- A pitchers mound
- A speed radar that will indicate the velocity of the thrown ball.
- A video camera that will record the pitcher's mechanics.
- A backdrop picture of fans which is inserted behind the catcher to replicate reality.

In accordance with a preferred embodiment of the invention a system for practicing pitching, includes a batter mannequin which is selectively movable to either a right handed batting position or to a left handed batting position. A catcher mannequin is disposed behind the batter mannequin, the catcher mannequin being selectively positionable along a transverse path. A remote control unit controls the movement of the batter mannequin and the positioning of the catcher mannequin.

In an aspect of the invention, the batter mannequin has a body which is bilaterally symmetrical about a median plane.

In another aspect of the invention, the batter mannequin is disposed on a turntable which rotates about 180°.

In another aspect of the invention, the turntable rotates about a fixed plate which is disposed in front of the batter mannequin.

In another aspect of the invention, the batter mannequin has a rotatable head which automatically assumes a left-looking position when the batter mannequin is in the right handed batting position, and automatically assumes a right-looking position when the batter mannequin is in the left handed batting position.

In another aspect of the invention, the batter mannequin has both a left-looking face and a right-looking face.

In another aspect of the invention, the batter mannequin selectively movable toward or away from the fixed plate. The remote control unit controls the movement of the batter mannequin with respect to the fixed plate.

In another aspect of the invention, the catcher mannequin has a mitt, the mitt selectively positionable in a vertical direction. The remote control unit controls the vertical positioning of the mitt.

In another aspect of the invention, the mitt has an impact sensor, so that when the ball strikes said mitt a signal is generated.

In another aspect of the invention, the remote control unit is located adjacent to the pitcher so that the pitcher can control the movement and positioning of the various elements of the system.

In another aspect of the invention, the remote control unit can be placed at any given location where a coach or another individual can control the target while the pitcher practices.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 2 is a front perspective view of the system;

FIG. 3 is a front elevation view of the system;

FIG. 4 is a side elevation view of the system;

DETAILED DESCRIPTION OF THE INVENTION

Figure 1:
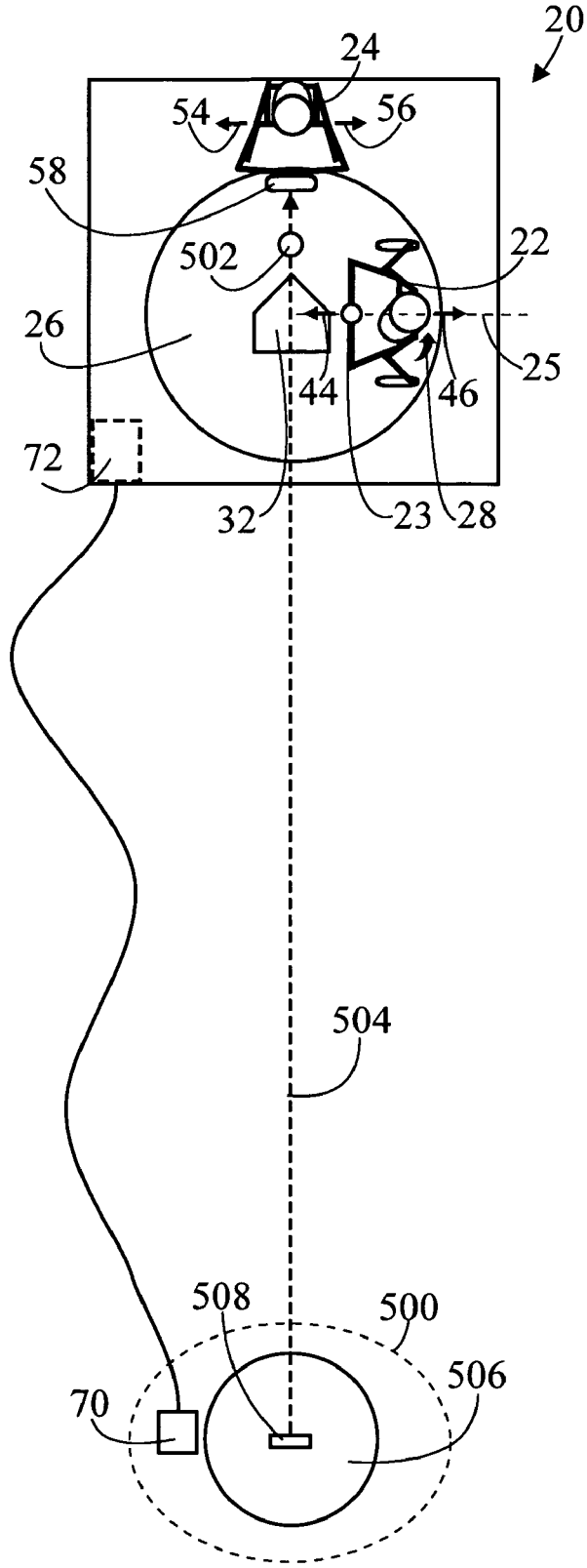
FIG. 1 is a reduced top plan view of a system for practicing pitching in accordance with the present invention.

Referring initially to FIGS. 1-5, there are illustrated reduced top plan, front perspective, front elevation, side elevation, and opposite front perspective views respectively of a system for practicing pitching, generally designated as 20. System 20 includes a batter mannequin 22 holding a bat 23 and a catcher mannequin 24. A user (pitcher) is disposed at a pitching area 500, and throws a ball 502, for example a baseball or a softball, along a general line of flight 504 toward catcher mannequin 24 as is done in the real games of baseball of softball. The pitching area 500 can include a pitching mound 506 and a pitching rubber 508.

In the drawings, batter mannequin 22 and catcher mannequin 24 are shown only as frames. However, it may be appreciated that batter mannequin 22 and catcher mannequin 24 comprise life size replicas of ball players wherein the frames are surrounded with a polymer or other material which fills out their bodies so that they have a realistic appearance (refer also to FIGS. 11 and 12). In a possible embodiment of the invention a 8 lb. self skinning flexible foam is molded around the frames to fill out the bodies of the mannequins. Such a foam is available from BJB Enterprises, Inc., 14791 Franklin Ave., Tustin, Calif. 92780, under the product number TC-280 A/B. Additionally, the mannequins may be painted to simulate a uniform, or alternatively may wear an actual uniform. Furthermore, the bodies, faces, and uniforms of the mannequins may even be designed to look like a famous player.

Figure 5:
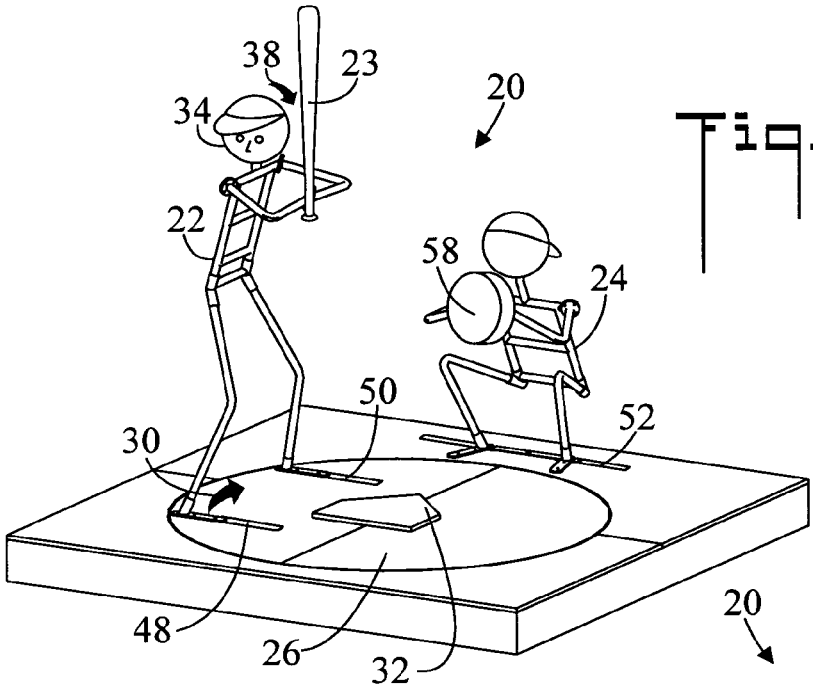
FIG. 5 is an opposite front perspective view of the system.

Batter mannequin 22 is selectively movable to a right handed batting position (FIG. 2) or to a left handed batting position (FIG. 5). In the shown embodiment, batter mannequin 22 is disposed upon a turntable 26 which rotates about 180° to effect the right and left handed batting positions. In FIG. 2 turntable 26 has been rotated in direction 28 so that batter mannequin 22 assumes a right handed batting position. Conversely, in FIG. 5 turntable 26 has been rotated in direction 30 so that batter mannequin 22 assumes a left handed batting position. Turntable 26 rotates about a fixed plate 32 (home plate) which is disposed in front of batter mannequin 22. As used herein, "disposed in front of batter mannequin 22" means that batter mannequin 22 and fixed plate 32 are in the same relationship as in an actual game of baseball or softball, wherein the body of the batter generally faces home-plate. It may be appreciated however, that rotational means other than turntable 26 could be employed to effect the movement to either the right handed or left handed batting positions. For example, batter mannequin 22 could rotate 180° around a track.

In an embodiment of the invention batter mannequin 22 has a rotatable head 34. Rotatable head 34 automatically assumes a left-looking position when batter mannequin 22 is in a right handed batting position (FIG. 2). That is, rotatable head 34 turns to the left in direction 36 so as to look at pitching area 500. Conversely, rotatable head 34 automatically assuming a right-looking position when batter mannequin 22 is in a left handed batting position (FIG. 5). That is, rotatable head 34 turns to the right in direction 38 so as to look at pitching area 500.

Figure 13:
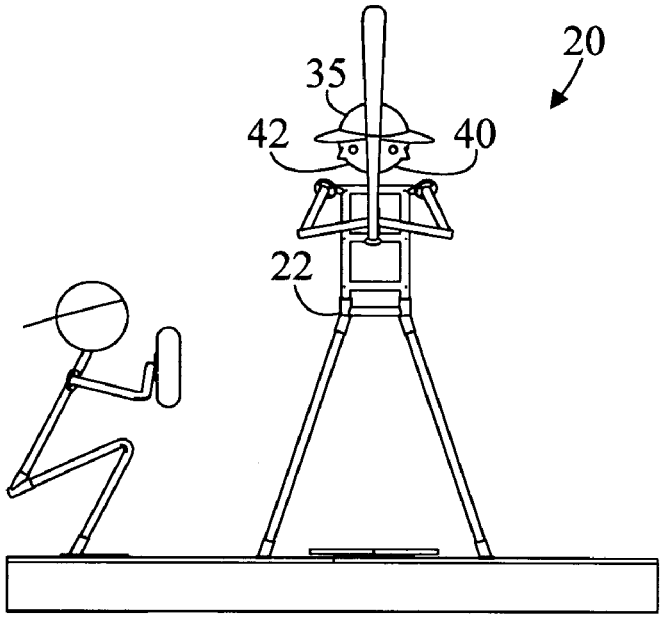
FIG. 13 is a side elevation view of an embodiment in which the head of the batter mannequin has both a left-looking face and a right-looking face.

In another embodiment of the invention, rather than having a rotating head 34, batter mannequin 22 has a head 35 with both a left-looking face 40 and a right-looking face 42 (refer to FIG. 13). As such, face 40 will look toward pitching area 500 when batter mannequin 22 is in a right handed batting position, and face 42 will look toward pitching area 500 when batter mannequin 22 is in a left handed batting position.

In another embodiment of the invention, batter mannequin 22 is selectively movable toward or away from fixed plate 32 in directions 44 and 46 respectively (refer to FIG. 3). This feature of the present invention simulates a batter crowding or standing away from home plate. In the shown embodiment, batter mannequin 22 moves along paths (tracks) 48 and 50 toward or away from fixed plate 32.

Catcher mannequin 24 is disposed behind batter mannequin 22, and is selectively positionable along a transverse path. As used herein "disposed behind batter mannequin 22" means that catcher mannequin 24 and batter mannequin 22 are in the same relationship as in an actual game of baseball or softball, wherein the batter is disposed between the pitching area and the catcher, and home plate is also generally disposed between the pitching area and the catcher. Similarly, batter mannequin 22 is disposed in front of catcher mannequin 24. Catcher mannequin 24 is positionable from side-to-side along transverse path (track) 52 in directions 54 and 56 (refer to FIG. 2). This feature of the present invention simulates the catcher moving to the outside or inside corner of the plate as is done in the actual game of baseball or softball. Transverse path 52 is substantially perpendicular to the line of flight 504 of ball 502 (refer to FIG. 1).

Referring to FIG. 4, the use of one batter mannequin 22 for both right handed and left handed batting positions is made possible by the symmetrical design of batter mannequin 22. When viewed from the front (as in FIG. 4), batter mannequin 22 has a body 27 (including the torso, upper arms, hands, legs, and feet) which is bilaterally symmetrical about a vertical median plane 25 (shown on end) (also refer to FIG. 1). Because of this feature, body 27 of batter mannequin 22 looks the same in either the right handed or left handed batting positions.

Referring to FIG. 3, catcher mannequin 24 has a mitt 58 which is selectively positionable in vertical directions 60 and 62 (mitt raised or lowered). The aforementioned transverse movement of catcher mannequin 24 coupled with the vertical movement of mitt 58 serve to simulate the positioning of the catcher's mitt as a target for the pitcher. Mitt 58 has an impact sensor (such as an accelerometer or a mechanical switch), so that when ball 502 strikes mitt 58 a signal is generated. The signal could be used to broadcast an audio message such as "strike" through a speaker.

A remote control unit 70 (refer to FIG. 14) controls (1) the movement of batter mannequin 22 to either a right handed batting position or a left handed batting position, (2) the movement of batter mannequin 22 with respect to (toward or away from) fixed plate 32, (3) the transverse positioning of catcher mannequin 24, and (4) the vertical movement of mitt 58. In an embodiment of the invention, remote control unit 70 is located adjacent to pitching area 500 (refer to FIG. 1) so that the movement and positioning of batter mannequin 22 and catcher mannequin 24 may be remotely controlled by the user (pitcher). It may be appreciated however, that remote control unit 70 could also be controlled by another individual, such as a coach, who could be located anywhere near system 20. Remote control unit 70 may either be hardwired as is shown in FIG. 1, or could use wireless technology similar to a TV remote control. Remote control unit 70 communicates with a controller 72 located in system 20 which, based upon signals from remote control unit 70, directs the previously described movements and positionings.

Figure 6:
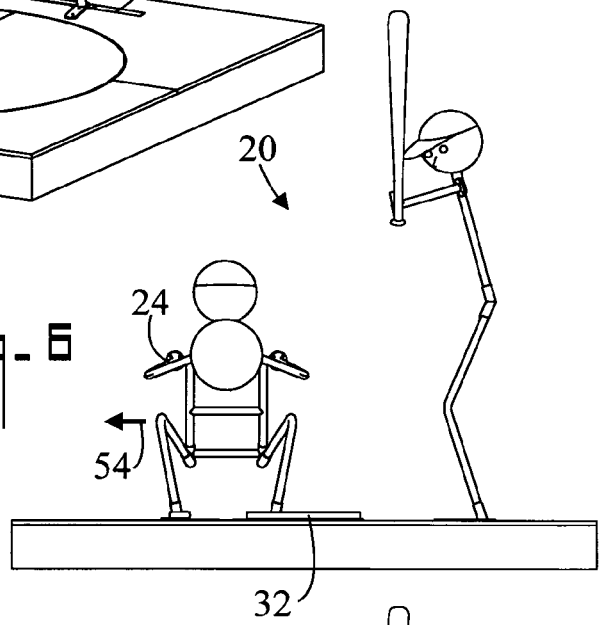
FIG. 6 is front elevation view showing a catcher mannequin moved to a left position.

FIG. 6 is front elevation view showing catcher mannequin 24 moved in direction 54 to to a left position.

Figure 7:
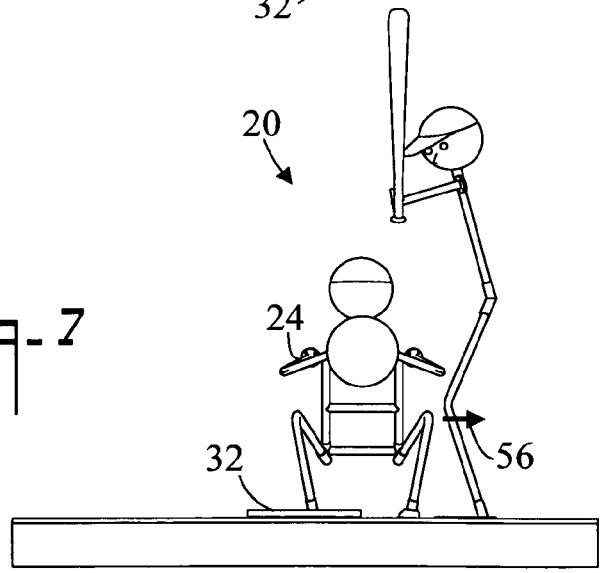
FIG. 7 is a front elevation view showing the catcher mannequin moved to a right position.

FIG. 7 is a front elevation view showing catcher mannequin 24 moved in direction 56 to a right position.

Figure 8:
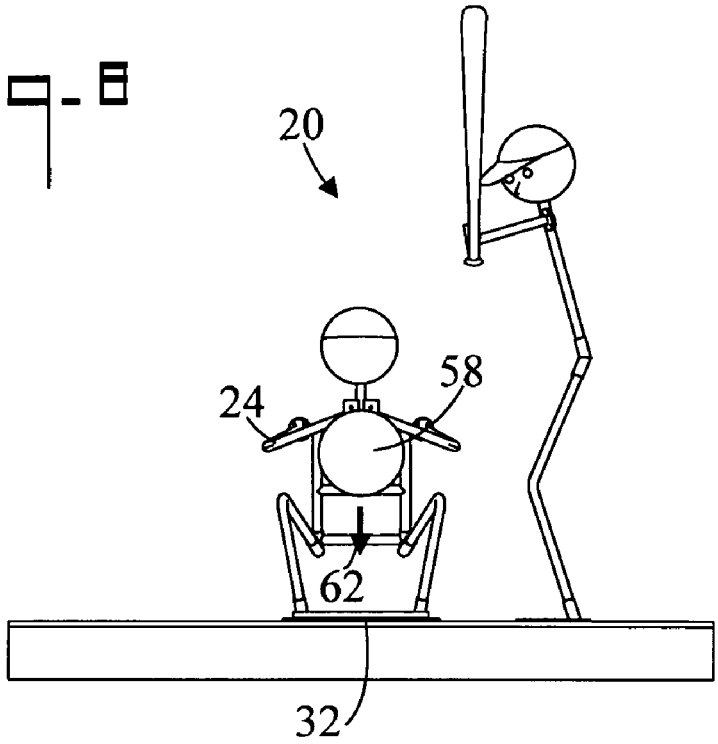
FIG. 8 is a front elevation view showing the catcher mannequin's mitt moved down.
Figure 9:
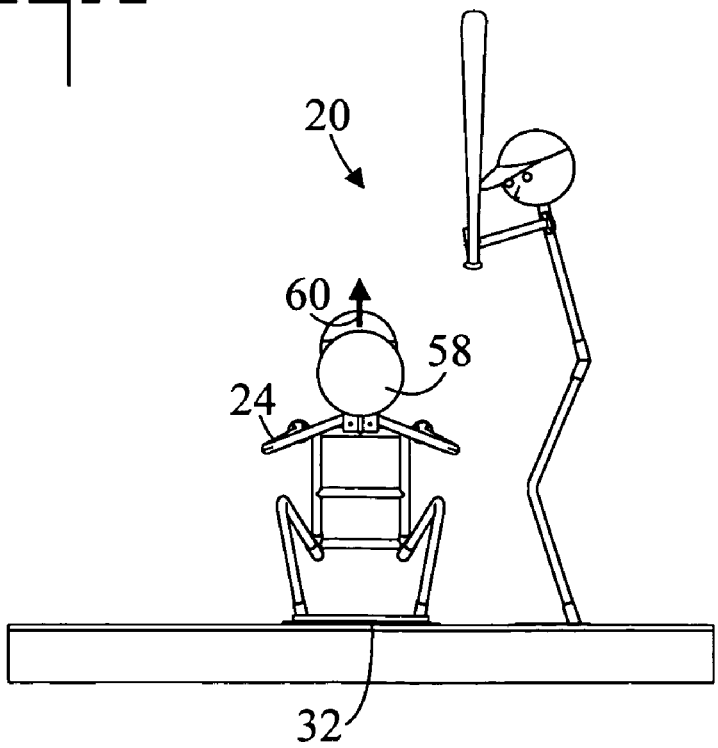
FIG. 9 is a front elevation view showing the catcher mannequin's mitt moved up'
Figure 10:
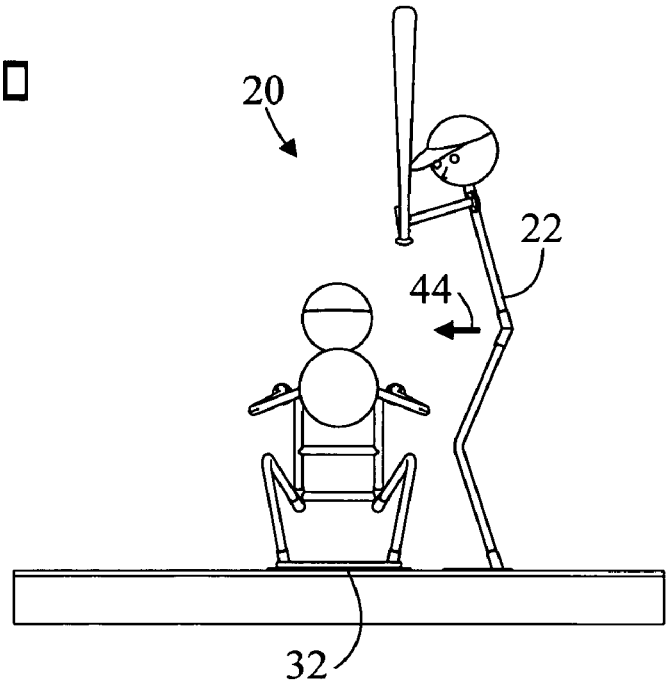
FIG. 10 is a front elevation view showing the batter mannequin moved toward a fixed plate.
Figure 11:
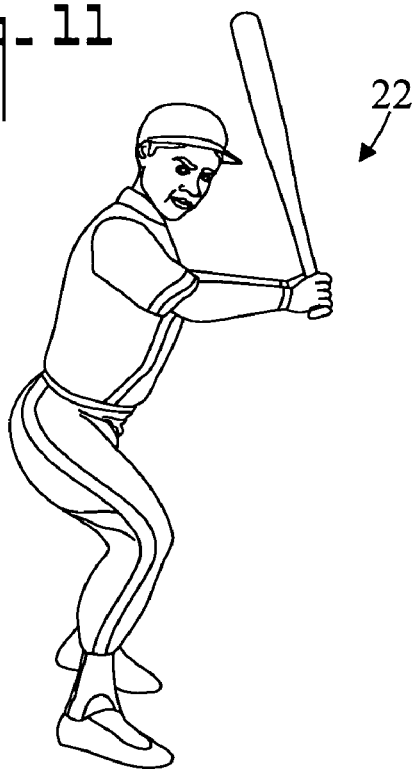
FIG. 11 is a front elevation view of a filled out batter mannequin wearing a uniform.
Figure 12:
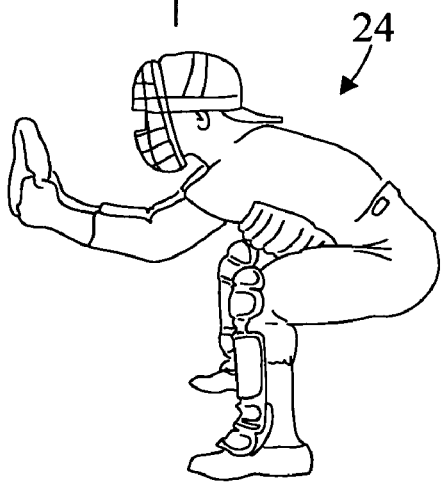
FIG. 12 is a side elevation view of a filled out catcher mannequin wearing a uniform.

FIG. 8 is a front elevation view showing catcher mannequin's mitt 58 moved down in direction 62;

FIG. 9 is a front elevation view showing catcher mannequin's mitt 58 moved up in direction 60;

FIG. 10 is a front elevation view showing batter mannequin 22 moved in direction 44 toward fixed plate 32;

FIG. 11 is a front elevation view of a filled out batter mannequin 22 wearing a uniform;

FIG. 12 is a side elevation view of a filled out catcher 24 mannequin wearing a uniform;

FIG. 13 is a side elevation view of an embodiment in which head 35 of batter mannequin 22 has both a left-looking face 40 and a right-looking face 42. As such, face 40 will look toward pitching area 500 when batter mannequin 22 is in a right handed batting position, and face 42 will look toward pitching area 500 when batter mannequin 22 is in a left handed batting position.

Figure 14:
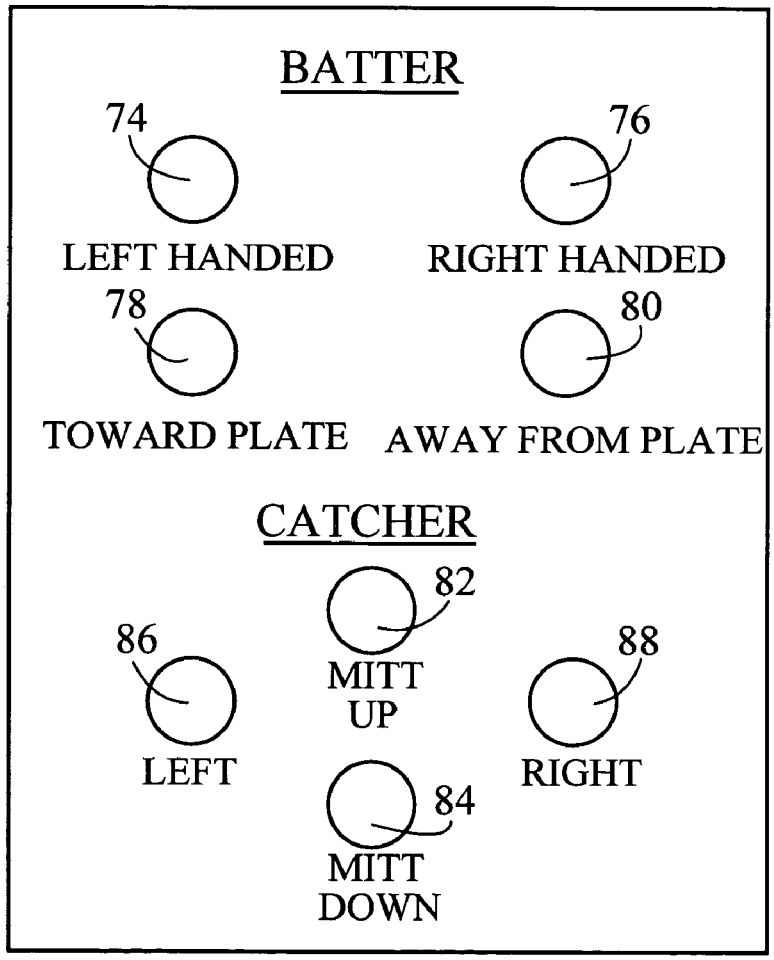
FIG. 14 is a top plan view of a remote control unit.

FIG. 14 is a top plan view of remote control unit 70. The controls of remote control unit 70 are divided into BATTER controls and CATCHER controls. In the shown embodiment, remote control unit 70 includes a LEFT HANDED control 74 which causes batter mannequin 22 to assume a left handed batting position (FIG. 5), and a RIGHT HANDED control 76 which causes batter mannequin 22 to assume a right handed batting position (FIG. 2). Pressing one of the controls causes the desired movement.

TOWARD PLATE control 78 cause batter mannequin 22 to move toward fixed plate 32, and AWAY FROM PLATE control 80 causes batter mannequin 22 to move away from fixed plate 32. The motion of batter mannequin 22 starts when either TOWARD PLATE control 78 or AWAY FROM PLATE control 80 is pressed, and continues as long as the control remains pressed or until a stop switch is encountered. When the control is released, the motion stops leaving batter mannequin in a desired position.

As for the CATCHER controls, the MITT UP control causes 82 mitt 58 to move upward, and the MITT DOWN control 84 causes mitt 58 to move downward. As with the TOWARD PLATE control 78 and AWAY FROM PLATE control 80, these are press and hold controls.

The LEFT control 86 causes catcher mannequin 24 to move left, and the RIGHT control 88 causes catcher mannequin 24 to move right. As with the TOWARD PLATE control 78 and AWAY FROM PLATE control 80, these are press and hold controls.

The various physical movements and positionings described above can be implemented by numerous means which are well known in the mechanical and electrical arts. For example, electrical motors, gears, chain drives, electromechanical actuators and the like can be utilized to effect the desired motion. The mechanical and electrical elements are actuated by remote control unit 70 via controller 72 (refer to FIG. 1).

Figure 15:
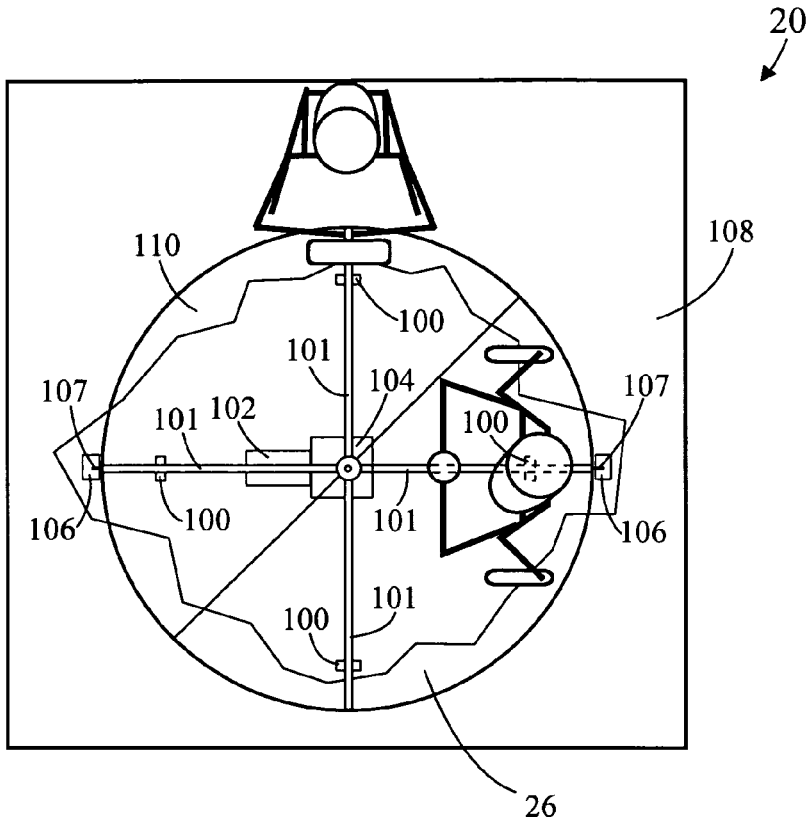
FIG. 15 is an enlarged top plan cutaway view of a turntable and associated elements.

For example, referring to FIG. 15, there is illustrated an enlarged top plan cutaway view of turntable 26 and associated elements showing a useful method of rotating turntable 26 180°. Turntable 26 rolls on bottom mounted casters 100 which are mounted on spars 101. A horizontally mounted AC electric motor 102 turns turntable 26 via a gearing assembly 104 which is mounted at the center of turntable 26. To limit the rotation of turntable 26, limit switches 106 are disposed on stationary frame 108. The limit switches 106 are activated by prongs 107 which are mounted on the edge of turntable 26. When prongs 107 actuate limit switches 106 the rotation of turntable 26 stops. In an embodiment of the invention two spaced-apart limit switches 106 are employed which act as a safety mechanism should one limit switch 106 fail. Additionally, a timer can be employed as a second safety mechanism. The timer shuts down rotation after a predetermined period of time. While the embodiment shown in FIG. 15 has been found useful, it may be appreciated however that the rotation methodology described above is not limiting, and the rotation could be effected in numerous other ways. In another embodiment of the invention, a top half portion 110 of turntable 26 is removable for maintenance purposes.

Figure 16:
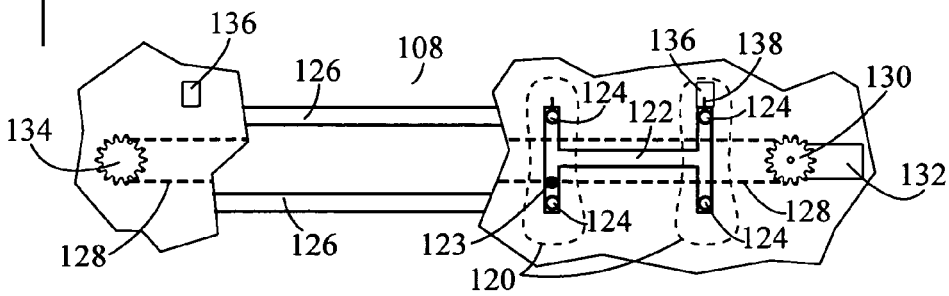
FIG. 16 is an enlarged top plan cutaway view showing a useful method for selectively position the catcher mannequin along a transverse path.

Now referring to FIG. 16, there is illustrated an enlarged top plan cutaway view showing a useful method for selectively position catcher mannequin 24 (refer to FIGS. 1 and 2) along its transverse path 52. The feet 120 of catcher mannequin 24 are connected to a trolley 122 having rods 124 which travel along two transverse slots 126 in stationary frame 108 (refer also to FIG. 15). Trolley 122 is connected at point 123 to a drive chain 128 which is connected to a gear 130 which is driven by electric motor 132 via appropriate gearing. Drive chain 128 is also connected to a second gear 134. When electric motor 132 is energized, drive chain 128 causes trolley 122 to move along transverse slots 126. In FIG. 16 trolley 122 has been positioned to its rightmost position. A limit switch 136 mounted on stationary frame 108 cooperates with a prong 138 on trolley 122 to stop motion at the end of transverse slots 126.

Figure 17:
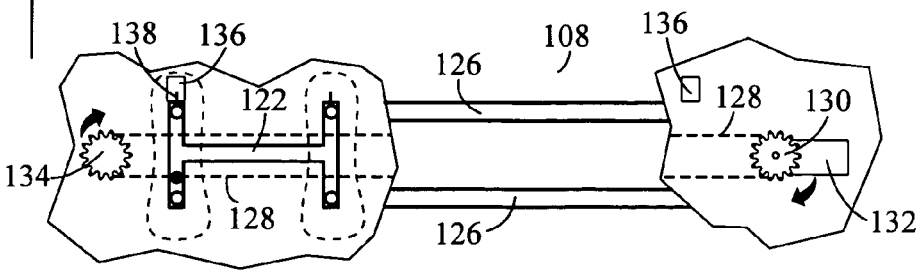
FIG. 17 is an enlarged top plan cutaway view showing a trolley positioned to its leftmost position.

Now referring to FIG. 17, there is illustrated an enlarged top plan cutaway view showing trolley 122 positioned to its leftmost position. Electric motor 132 has caused drive chain 128 to move trolley 122 to its leftmost position. Limit switch 136 has been activated by prong 138 to stop the leftward motion of trolley 122.

It is further noted that the method described above for transversely moving catcher mannequin 24 can also be applied to move batter mannequin 22 toward or away from plate 32 (refer to FIG. 2).

Figure 18:
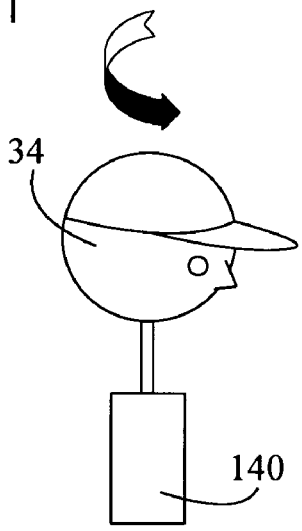
FIG. 18 is an enlarged front elevation view of a rotatable head in a left-looking position.
Figure 19:
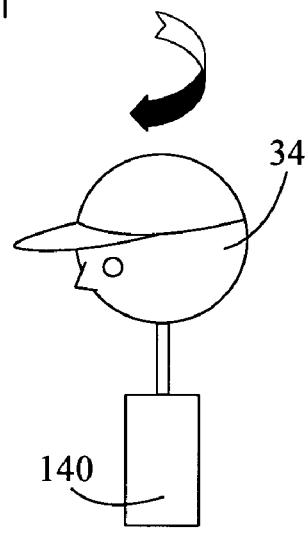
FIG. 19 is an enlarged front elevation view of a rotatable head in a right-looking position.

Now referring to FIGS. 18 and 19, there are illustrated an enlarged front elevation views of a rotatable head 34 showing a useful method for selectively positioning the head in a left-looking position and a right-looking position respectively. An electric motor 140 is used to change between the two head positions as turntable 26 is rotated (refer to FIGS. 2 and 5).

Figure 20:
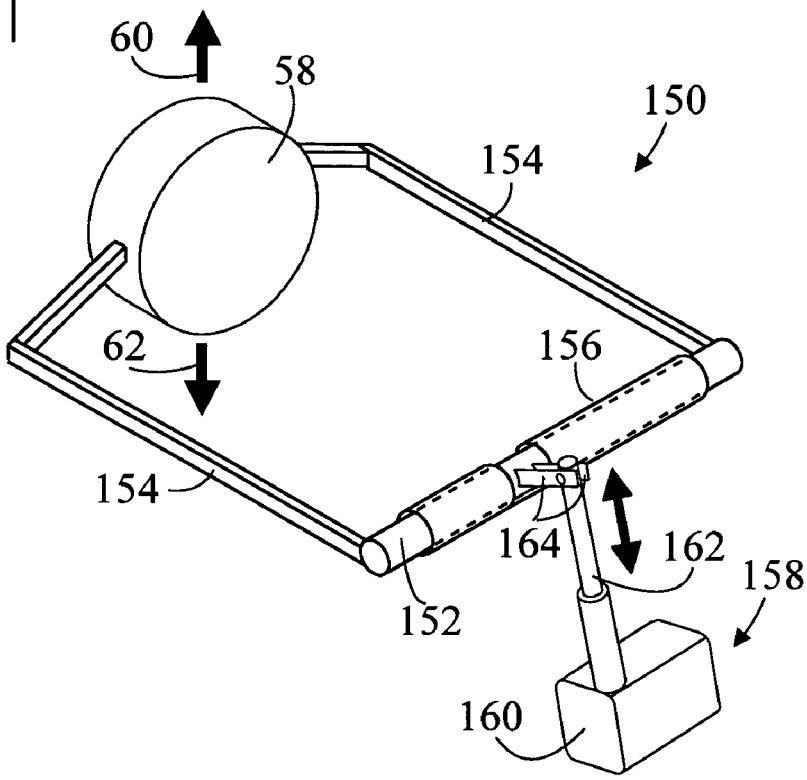
FIG. 20 is an enlarged perspective view of a mechanism for raising and lowering the catcher mannequin's mitt.

Now referring to FIG. 20, there is illustrated an enlarged perspective view showing a useful mechanism for raising and lowering the catcher mannequin's mitt 58, generally designated as 150. Mechanism 150 includes catcher mannequin mitt 58 which is connected to a rotatable rod 152 by catcher arms 154 (shown as a not filled out frame). Rotatable rod 152 rotates within a sleeve 156 which is connected to the frame of the catcher mannequin 24 (refer to FIG. 2). An electromechanical actuator 158 (such as McMaster-Carr, Model Number 2236K3) includes a body 160 and a longitudinally positionable plunger 162. Body of actuator 158 is connected to the fame of catcher mannequin 24 (refer also to FIG. 2). Plunger 162 is rotatably connected to one end of a pair of couplings 164, the other ends of couplings 164 being fixedly attached to rotatable rod 152. As plunger 162 is selectively retracted (refer also to FIG. 22) and extended (refer also to FIG. 23) the linear motion of plunger 162 is translated into rotary motion of rotatable rod 152. As rotatable rod 152 rotates, mitt 58 correspondingly moves up in direction 60 or down in direction 62.

Figure 21:
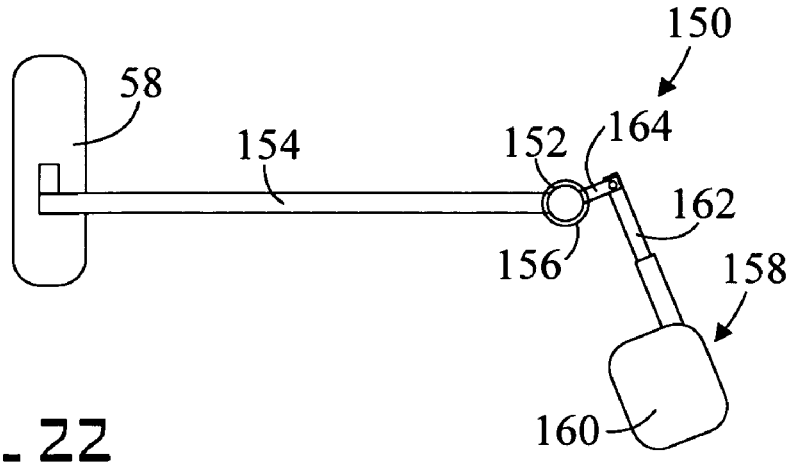
FIG. 21 is an enlarged side elevation view of the mechanism for raising and lowering the catcher mannequin's mitt showing the mitt in a center position.

FIG. 21 is an enlarged side elevation view of the mechanism for raising and lowering the catcher mannequin's mitt 150 showing the mitt 58 in a center position. Plunger 162 is in a mid position.

Figure 22:
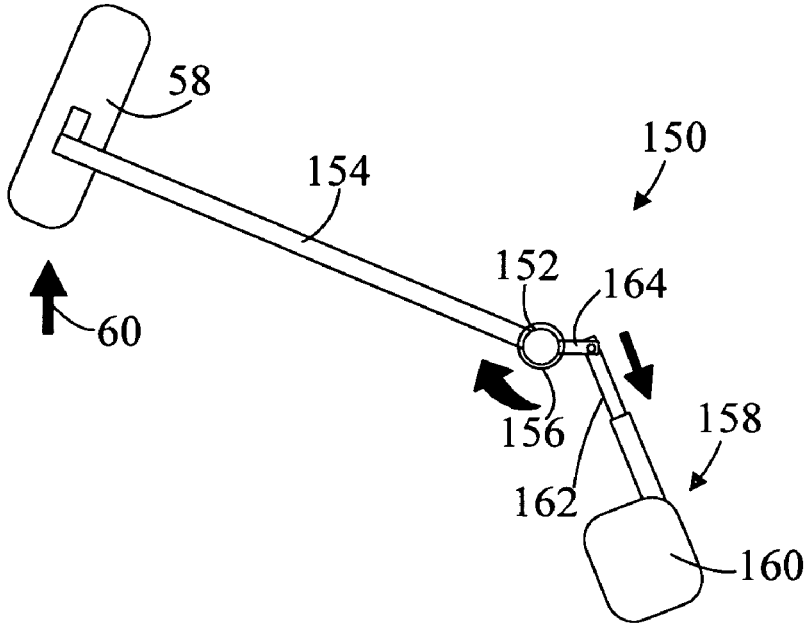
FIG. 22 is an enlarged side elevation view of the mechanism for raising and lowering the catcher mannequin's mitt showing the mitt in a raised position; and, FIG. 23 is an enlarged side elevation view of the mechanism for raising and lowering the catcher mannequin's mitt showing the mitt in a lowered position.

FIG. 22 is an enlarged side elevation view of the mechanism for raising and lowering the catcher mannequin's mitt 150 showing the mitt 58 in a raised position. Plunger 162 has been retracted causing rotatable rod 152 to rotate in a clockwise direction thereby raising mitt 58.

Figure 23:
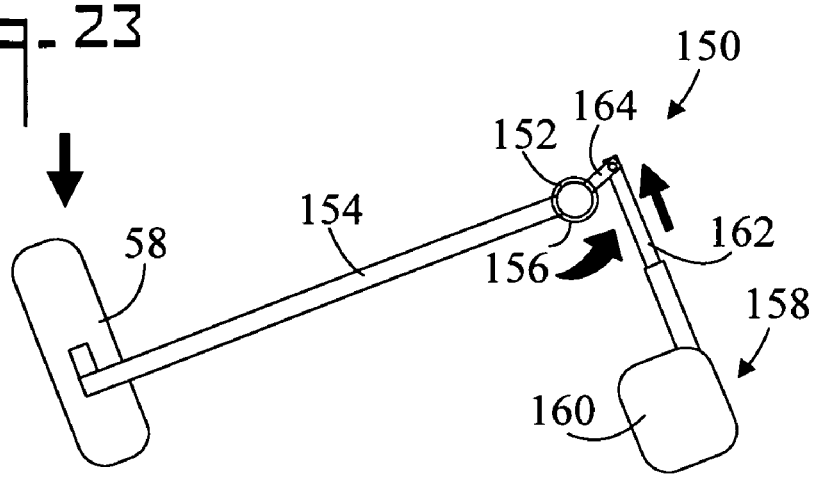

FIG. 23 is an enlarged side elevation view of the mechanism for raising and lowering the catcher mannequin's mitt 150 showing the mitt 58 in a lowered position. Plunger 162 has been extended causing rotatable rod 152 to rotate in a counterclockwise direction thereby lowering mitt 58.

In terms of use, a method for practicing pitching includes:

(a) providing a pitching area 500, a user disposed at said pitching area;

(b) providing a ball 502;

(c) providing a system 20 for practicing pitching including:

- a batter mannequin 22 selectively movable to a right handed batting position or to a left handed batting position;
- a catcher mannequin 24 disposed behind batter mannequin 22, catcher mannequin 24 selectively positionable along a transverse path; and, a remote control unit 70 for remotely controlling the movement of batter mannequin 22 and positioning of catcher mannequin 24;

(d) using remote control unit 70 to move batter mannequin 22 to either the right handed batting position or the left handed batting position;

(e) using remote control unit 70 to position catcher mannequin 24 to a desired position along the transverse path; and, (f) the user throwing ball 502 toward catcher mannequin 24.

The method further including:

in step (c), batter mannequin 22 having a body 27 which is bilaterally symmetrical about a vertical median plane 25 (refer to FIG. 4).

The method further including:

in step (c), batter mannequin 22 disposed on a turntable 26 which rotates about 180°, and, in step (d) turntable 26 rotating so that batter mannequin 22 assumes either the right handed batting position or the left handed batting position.

The method further including:

in step (c), turntable 26 rotating about a fixed plate 32 disposed in front of batter mannequin 22.

The method further including:

in step (c), batter mannequin 22 having a rotatable head 34, rotatable head 34 (1) automatically assuming a left-looking position when batter mannequin 22 is in the right handed batting position, and (2) automatically assuming a right-looking position when batter mannequin 22 is in the left handed batting position.

The method further including:

in step (c), batter mannequin 22 having both a left-looking face and a right-looking face.

The method further including:

in step (c), fixed plate 32 disposed in front of batter mannequin 32, batter mannequin 22 selectively movable toward or away from fixed plate 32; and, prior to step (f), using remote control unit 70 to position batter mannequin 22 to a desired position with respect to fixed plate 32.

The method further including:

in step (c), catcher mannequin 24 having a mitt 58, mitt 58 selectively positionable in a vertical direction; and, prior to step (f), using remote control unit 70 to position mitt 58 to a desired vertical position.

The method further including:

in step (c), mitt 58 having an impact sensor, so that when ball 502 strikes mitt 58 a signal is generated and sent to an audio device to announce that that mitt 58 has been struck.

The method further including:

in step (c), remote control unit 70 disposed adjacent to said pitching area; and, the user performing steps (d) and (e).

The preferred embodiments of the invention described herein are exemplary and numerous modifications, variations, and rearrangements can be readily envisioned to achieve an equivalent result, all of which are intended to be embraced within the scope of the appended claims.

I claim:

1. A system for practicing pitching, comprising:

a batter mannequin which rotates to a right handed batting position or to a left handed batting position;

a turntable having a perimeter and a center;

said batter mannequin disposed on said turntable in an off center position near said perimeter of said turntable; and, said turntable rotating about 180° to effect said right handed and left handed batting positions.

2. A system for practicing pitching, comprising:

a batter mannequin which rotates to a right handed batting position or to a left handed batting position;

a fixed plate disposed in front of said batter mannequin;

said batter mannequin rotating about said fixed plate;

a turntable having a perimeter and a center;

said batter mannequin disposed on said turntable in an off center position near said perimeter of said turntable;

said batter mannequin having a body which faces said center of said turntable;

said turntable rotating about 180° to effect said right handed and left handed batting positions;

one of (1) said batter mannequin having a rotatable head, said rotatable head automatically assuming a left-looking position when said batter mannequin is in said right handed batting position, and said rotatable head automatically assuming a right-looking position when said hatter mannequin is in said left handed batting position, and (2) said batter mannequin having both a left-looking face and a right-looking face;

when said body of said batter mannequin is viewed from the front, said body is bilaterally symmetrical about a vertical median plane;

a catcher mannequin disposed behind said batter mannequin; and, said catcher mannequin positionable with respect to said fixed plate, said positioning being from side to side along a transverse path.

* * * * *